United States Patent [19]

Claycomb

[11] Patent Number: 4,911,479

[45] Date of Patent: Mar. 27, 1990

[54] DURABLE BLAST JOINT

[76] Inventor: Jack R. Claycomb, 8226 Waynemer, Houston, Tex. 77040

[21] Appl. No.: 255,046

[22] Filed: Oct. 7, 1988

[51] Int. Cl.[4] ..... F16L 35/00

[52] U.S. Cl. ..... 285/39; 285/45; 285/328; 285/321; 166/243

[58] Field of Search ..... 285/18, 34, 45, 328, 285/321; 166/243

[56] References Cited

U.S. PATENT DOCUMENTS

| | | | |
|---|---|---|---|
| 3,895,832 | 7/1975 | Ellis et al. | 285/322 |
| 4,028,796 | 6/1977 | Bergstrom | 29/416 |
| 4,141,386 | 2/1979 | Bergstrom | 138/147 |
| 4,211,440 | 7/1980 | Bergstrom | 285/45 |
| 4,349,050 | 9/1982 | Bergstrom et al. | 138/147 |
| 4,381,821 | 5/1983 | Greene | 166/243 |
| 4,613,165 | 9/1986 | Kuhne | 285/45 |
| 4,685,518 | 8/1987 | Claycomb | 166/243 |
| 4,726,423 | 2/1988 | Claycomb | 166/380 |

*Primary Examiner*—Dave W. Arola

*Attorney, Agent, or Firm*—Pravel, Gambrell, Hewitt, Kimball & Krieger

[57] ABSTRACT

A durable blast joint using a protective sheath of erosion resistant rings arranged in overlapping stacks so as to provide a vertically continuous protective sheath for the full length of the blast joint, while also providing durable structural surfaces suitable for gripping with power tools.

13 Claims, 3 Drawing Sheets

DURABLE BLAST JOINT

FIELD OF THE INVENTION

This invention is in the field of blast joints suitable for service in production zones where the joint will be subjected to high speed particle impingement.

BACKGROUND OF THE INVENTION

In the drilling and production of oi and gas wells it is frequently necessary to penetrate one or more production zones to reach an underlying zone with production tubing. Each production zone is served by its own string of production tubing which then must penetrate the overlying production zones to reac the surface. At the point where each string of production tubing penetrates an overlying production zone, the tubing can be subjected to severe erosion.

Particularly where the production zone being penetrated produces high pressure gas, abrasive materials entrained in the gas can quickly erode the surface of the production tubing penetrating that zone. High pressure gas moves at very high velocities when the zone is producing and it can contain such entrained erosive materials as grains of sand or drops of liquid. Where the high velocity gas enters the well bore, it impinges upon the penetrating production tubing from an underlying zone and, depending upon the material from which the production tubing is made, the high velocity gas can quickly damage or even penetrate the wall of the production tubing.

When the wall of the production tubing has been penetrated in an overlying zone, communication is established between two different production zones through the failed production tubing string. Communication between zones can be highly undesirable, and isolation between the zones must be maintained. Isolation between the zones in the well bore is generally obtained by the use of packers about the production tubing between production zones. When erosion of production tubing has reached an advanced state it becomes necessary to replace the eroded section or sections of tubing. This requires removing the production tubing string from the well bore, replacement of the failed joints of tubing and reinsertion of the tubing string into the well bore along with any necessary replacement of packers.

Different tubing materials will erode at different rates and to different degrees depending upon the velocity of the impinging fluid as well as the type and amount of abrasive materials entrained in the fluid. Some materials are considered highly erosion resistant, and various methods have been used to incorporate these materials into the design of the production tubing where the tubing must penetrate overlying producing zones. Joints of pipe or tubing have been designed which incorporate a jacket of a highly erosion resistant material such as tungsten carbide over the production tubing. Various methods are used to insure that the tungsten carbide will surround the tubing at the areas where the high velocity fluid enters the well bore. The tungsten carbide is generally installed in stacks of relatively short rings and held in place longitudinally by various types of sleeves and collars. In some designs the rings are kept pressed together by the installation of a spring, such as a coil spring, around the tubing to press against the end of one of the tungsten carbide rings.

A major problem with the use of a highly erosion resistant material, such as tungsten carbide, is that such materials, while being very hard, are also very brittle and therefore subject to damage when placed under radial or axial loads. When making up a tubing string for insertion into a well, it is necessary to support the top joint on the string at the well head and to hold that joint against rotation while threading it to the next joint to be installed on the string. Power tongs or similar tools are normally used to hold one joint against rotation while rotating the next joint being installed in order to thread the two joints together. Such power equipment necessarily bites into the surface of the tubing joint in order to apply the necessary torque to either hold the joint against rotation or to rotate the joint in making up the thread. If such power tools are used on a surface of the blast joint where the erosion resistant material, such as tungsten carbide, is exposed, the torque is not efficiently transferred to the tubing and the tungsten carbide rings can easily become chipped and cracked, resulting in a loss of protection against abrasion once placed into service in a production zone.

Another operation frequently encountered which can result in damage to the tungsten carbide rings is the gripping of a blast joint from above with pipe slips having upwardly canted internal teeth. These teeth must necessarily dig into the surface of the joint to achieve their gripping action in order to pull the blast joint or other piece of equipment out of the well bore. Gripping of a blast joint by such a slip, if the slip teeth contact the tungsten carbide rings, can result in cracking or breaking of the rings as mentioned before in the case of power tongs, by the application of radial or axial forces, through the slip teeth.

Some blast joints, using tungsten carbide rings, incorporate thin metal sleeves on the outside of the tungsten carbide rings, but these sleeves are of insufficient strength to withstand the radial and axial stresses imparted by power tools, and the sleeves typically are not mounted to the inner production tubing with sufficient mechanical strength to transfer the necessary torque or axial force to the tubing itself. These thin sleeves are generally only effective at protecting the tungsten carbide rings during assembly and handling which does not involved the use of the aforementioned power tools.

Presently known blast joints, therefore, in addition to being very expensive, re somewhat fragile, and they cannot be installed in a string of production tubing as if they were simply another joint of production tubing. It is desirable to design a blast joint which provides protection against erosion for its full length without any gaps, but which can be handled by the use of power tongs and pipe slips without any unusual degradation of the joint. It is further desirable to design such a blast joint which can be threaded into place in a production tubing string as if it were simply another joint of production tubing, either as a single joint or as a string of consecutive joints having a continuous protective sheath of tungsten carbide rings without any gaps in between.

SUMMARY OF THE INVENTION

This invention is a blast Joint which can be handled as a normal section of production tubing or pipe using power tongs, pipe slips, or other power equipment, but which exhibits a continuous protective sheath of erosion resistant material for essentially its full length. A lower housing is provided on the blast joint of this invention which can be handled using power tongs and which provides erosion resistance by using overlapping stacks of erosion resistant rings for its full length. This invention further includes an intermediate housing which provides raised annular surfaces, suitable for gripping with slip teeth, alternating with annular rings of erosion resistant material which overlap annular rings of erosion resistant material underlying the raised gripping surfaces. This invention further includes an upper housing which incorporates a skirt suitable for gripping with power tongs and which also includes overlapping stacks of erosion resistant rings for its full length. The lower, intermediate and upper housings are mounted on an inner joint of production pipe or tubing in order to impart thereto the axial and radial loads and the torque as required to make up the blast joint of this invention with adjacent tubing joints or blast joints. The overlapping stacks of erosion resistant rings run continuously from near the lower threaded end of the inner pipe joint to above the upper threaded end of the inner pipe joint so as to create a continuous protective sheath of erosion resistant material for the full length of a string of successive blast joints.

DETAILED DESCRIPTION OF THE INVENTION

Figure 1:
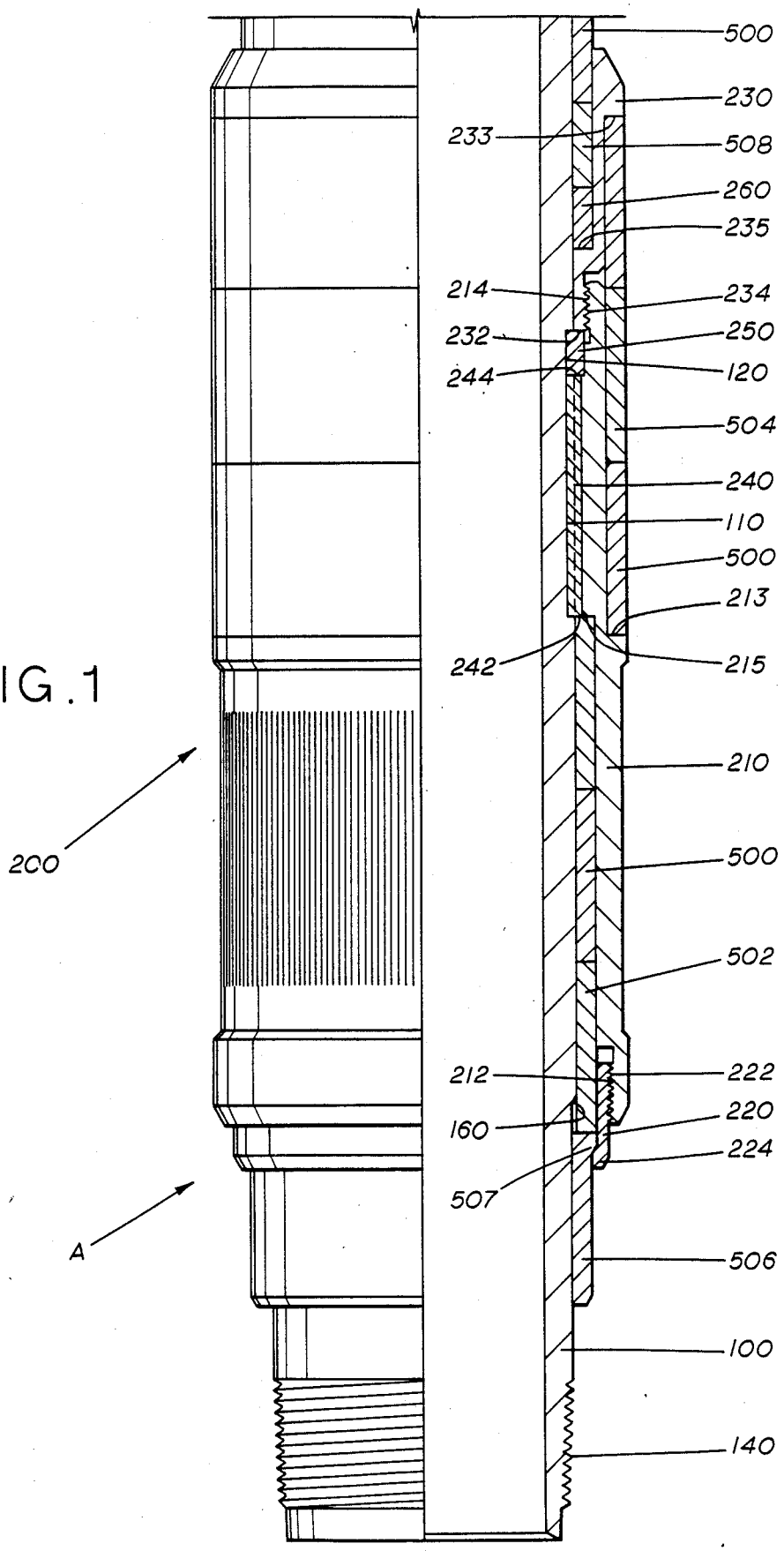
FIG. 1 is a partial cross-section of the lower end of the blast joint of the present invention showing the lower housing.

A detailed description of the preferred embodiment of the invention will now be given, illustrated in the drawings as applied to a particular type of drill pipe. It will be understood that this invention can easily be adapted to any size or type of drill pipe or tubing.

As shown in FIG. 1, blast joint A incorporates at its innermost diameter inner pipe 100. Blast protection of this pipe 100 is achieved by applying a protective sheath which incorporates three types of housings. Shown in FIG. 1 is lower housing 200. Lower housing 200 consists of lower housing body 210, lower housing end sleeve 220 and lower housing locking collar 230. End sleeve 220 is fastened to body 210 by the engagement of lower housing end sleeve threads 222 and body lower threads 212. Lower housing body 210 is fastened to lower housing locking collar 230 by the engagement of body upper threads 214 and locking collar threads 234. Inner pipe 100 has machined into its outer surface a plurality of longitudinal spline grooves 110 and annular snap ring groove 120. A plurality of splines 240 lie in spline grooves 110, partially protruding therefrom into matching longitudinal grooves in lower housing body 210. Similar]y, lower housing retainer snap ring 250 lies in snap ring groove 120 partially protruding therefrom into a matching recess in lower housing body 210. Splines 240 prevent lower housing 200 from angular movement or rotation relative to inner pipe 100. Retainer snap ring 250 prevents lower housing 200 from moving longitudinally relative to inner pipe 100.

Lower housing 200 serves to hold in place and protect a plurality of erosion resistant rings 500 made of a hard material such as tungsten carbide. Erosion resistant rings 500 are arranged in vertical stacks concentric with inner pipe 100 so that successive stacks overlap one another at their ends. This results in a vertically continuous protective sheath of erosion resistant rings 500 from a point below lower housing 200 to a point above lower housing 200 without leaving a vertical gap between any of the erosion resistant rings 500. In odder to accomplish this overlapping arrangement, the majority of rings 500 have one of two different diameters, with small diameter rings 502 lying directly on the outer surface of inner pipe 100 and large diameter rings 504 lying radially outward from small diameter rings 502. The thickness and vertical length of erosion resistant rings 500 can be varied as desired, with a standard length being either one inch or two inches. In addition to the small and large diameter rings 502 and 504, certain specially shaped rings are used at particular points in blast joint A. The first example is lower end ring 506 which has a slightly smaller inner diameter than small diameter rings 502 in order to conform closely to the outer surface of the particular inner pipe 100, which as shown here, has lower shoulder 160 immediately above lower threads 140. Lower end ring 506 also has, on its external surface, shoulder 507 which enables lower end ring 506 to be held in place by lower housing end sleeve 220, which Captures lower end ring 506 by mean of lower end ring lip 224. This arrangement of lower end ring 506 extending beyond end sleeve 220 makes possible the overlapping of erosion resistant rings 500 with similar rings found at the upper end of the next lower blast joint if assembled.

Lower housing body 210 has an internal annular recess and an external annular recess in which erosion resistant rings 500 are arranged abutting internal recess shoulder 215 and external recess shoulder 213. Small diameter rings 502 can also abut lower housing spline lower end 242, but this is not essential. Lower housing locking collar 230 also has internal and external annular recesses in which erosion resistant rings 500 are arranged in an overlapping fashion. Large diameter rings 504 abut external recess shoulder 233 while small diameter rings 502 can abut internal recess shoulder 235, or as shown, interposed therebetween can be spacer ring 260. Spacer ring 260 is used in conjunction with appropriately sized short ring 508 or with a standard sized small diameter ring 502 as required in make-up of blast joint A to achieve the desired overall length of the stack of erosion resistant rings 500. If it is used, spacer ring 260 must have a short enough vertical length to insure that overlap exists between the stacks of small diameter rings 502 and large diameter rings 504 at the upper end of lower housing 200.

Figure 2:
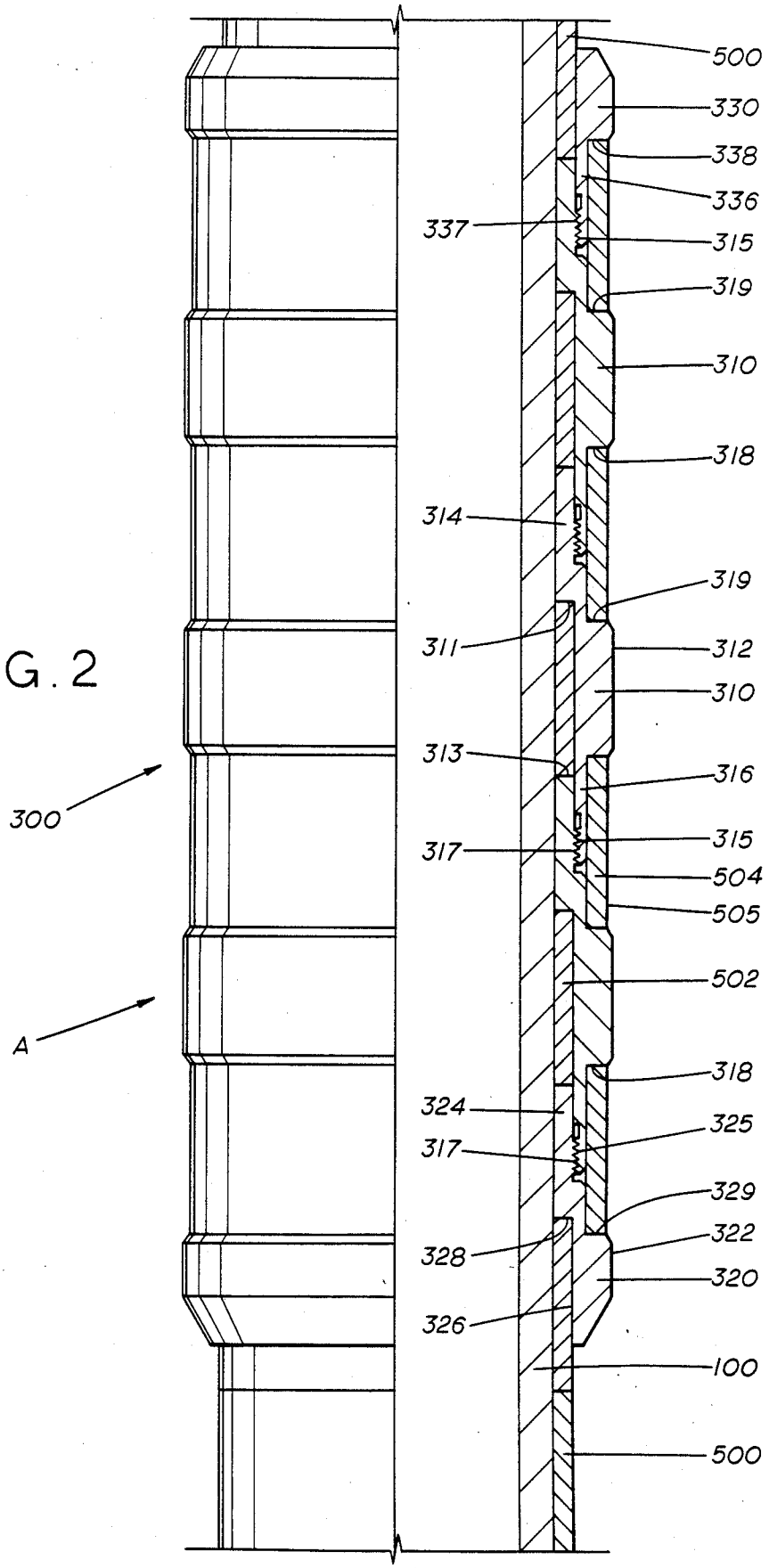
FIG. 2 is a partial ross-section of an intermediate segment of the blast joint of the present invention showing the intermediate housing.

Referring now to FIG. 2, intermediate housing 300 can be seen as it is assembled on the blast joint at some point above lower housing 200. Because intermediate housing 300 is designed to provide a gripping surface for pipe slips, it will normally be located near the upper end of blast joint A; immediately below upper housing 400. It should be noted that a stack of small diameter rings 502 extends from the upper end of lower housing 200 and that this stack continues without interruption to the lower end of intermediate housing 300 as shown.

Intermediate housing 300 is composed of three basic types of structural members. Most of the vertical length of intermediate housing 300 is structurally composed of interlocking bridge rings 310; each of which has an upper cylinder 314 and a lower cylinder 316. Each lower cylinder 316 is fastened to the upper cylinder 314 of the next lowermost bridge ring 310. In the embodiment shown, this fastening is achieved by engagement between upper cylinder threads 315 and lower cylinder threads 317. The lower end of intermediate housing 300 consists of intermediate housing bottom ring 320 which has an upper cylinder 324 fastened to lower cylinder 316 of the next uppermost interlocking bridge ring 310 by engagement between upper cylinder threads 325 and lower cylinder threads 317. The upper end of intermediate housing 300 is formed by intermediate housing top ring 330 which has lower cylinder 336 fastened to upper cylinder 314 of the next lowermost interlocking bridge ring 310 by engagement between lower cylinder threads 337 and upper cylinder threads 315.

Arranged in alternating fashion between the structural rings 310, 320 and 330 are erosion resistant rings 500 can be arranged singly or in stacks depending upon the vertical height of each member. As before, small diameter rings 502 and large diameter rings 504 are arranged in internal and external annular recesses in structural rings 310, 320 and 330 in an overlapping fashion. This insure a vertically continuous stack of erosion resistant rings having no vertical gap therebetween. As shown, each small diameter ring 502 abuts an upper cylinder end 313 and an internal recess shoulder 311 while each large diameter ring 504 abuts external recess upper shoulder 318 and external recess lower shoulder 319. The shape of structural rings 310, 320 and 330 is such that a continuous structural bridge is formed which rests directly on the external surface of inner pipe 100 and which presents a raised annular surface 312 above the external surface of large diameter rings 504. Raised annular surfaces 312 are spaced properly to insure that intermediate housing 300 can be gripped with pipe slips with the slip teeth contacting only raised annular surfaces 312 and no contacting the external surfaces of large diameter rings 504.

Figure 3:
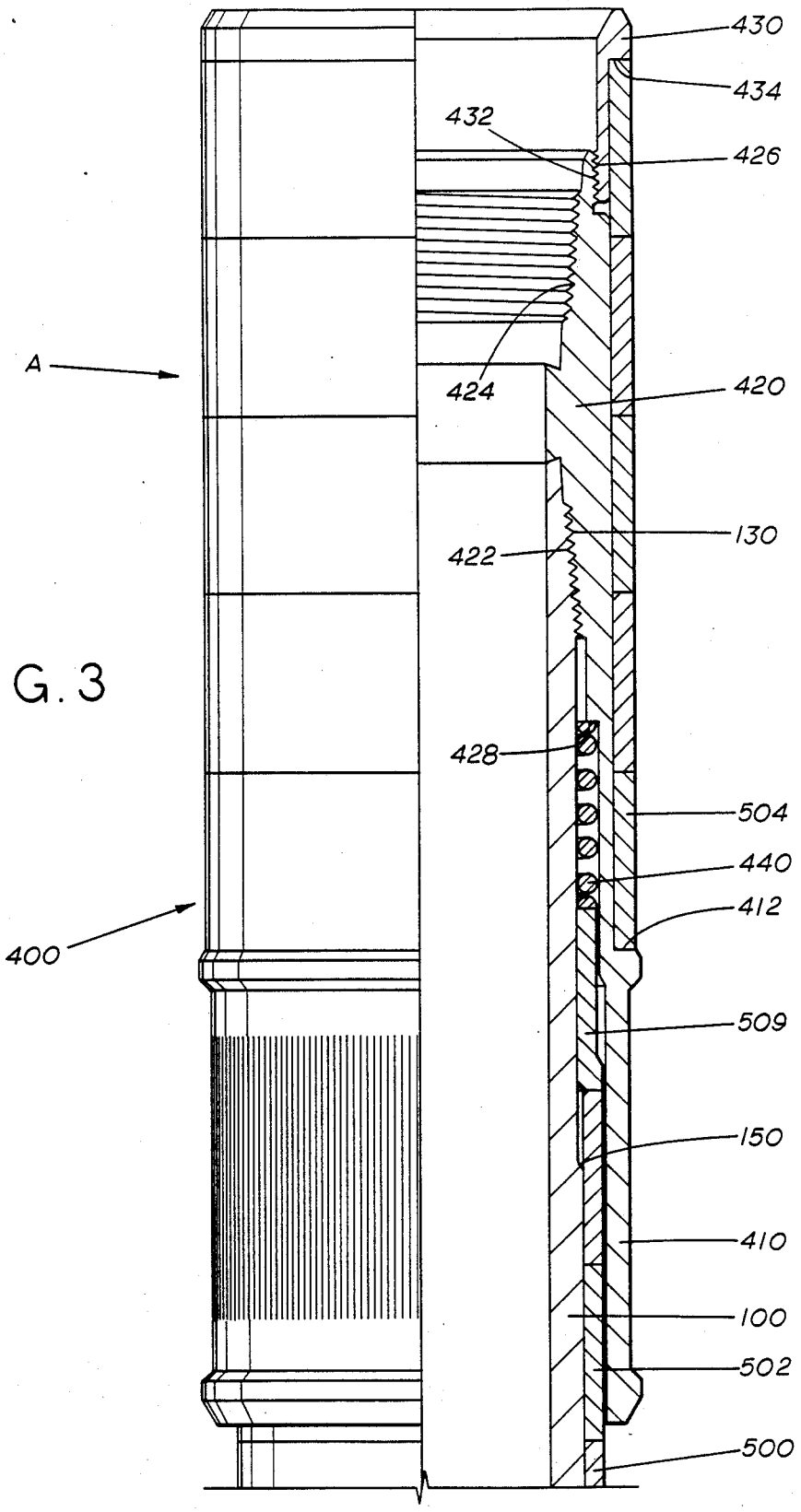
FIG. 3 is a partial cross-section of the upper end of the blast Joint of the present invention showing the upper housing.

Referring now to FIG. 3, the upper end of blast joint A has upper housing 400 composed mainly of upper housing skirt 410, coupling 420 and top collar 430. Coupling 420 has lower joint threads 422 and upper joint threads 424 with lower Joint threads 422 enlarging inner pipe upper threads 130 to mount upper housing 400 on blast joint A. Upper joint threads 424 are provided to joint blast joint A with the next uppermost joint of pipe or another blast joint. Attached to the lower end of coupling 420 is the upper end of skirt 410 which extends downward around, and spaced outwardly from, inner pipe 100. The upper end of coupling 420 is joined to upper housing top collar 430 such as by the engagement between coupling collar threads 426 and top collar inner threads 432. Skirt 410, coupling 420 and top collar 430 have internal and external annular recesses which overlap. Arranged in these recesses are erosion resistant rings 500 with small diameter rings 502 lying in the internal annular recess and large diameter rings 504 lying in the external annular recess in an overlapping fashion. Small diameter rings 502 shown here are the upper extension of the stack of small diameter rings 502 which extends beyond the upper end of intermediate hosing 300 in a continuous stack. Reducer ring 509 can be used as shown to conform to upper shoulder 150 where inner pipe 100 reduces from its outside diameter immediately under upper threads 130.

Large diameter rings 504 are held in the external annular recess by abutting external recess lower shoulder 412 and external recess upper shoulder 434. Pressing downward on reducer ring 509 is load spring 440 which abuts upper housing spring shoulder 428. Load spring 440 applies constant pressure to erosion resistant rings 500 located between load spring 440 and lower housing retainer snap ring 250. This insures that all such erosion resistant rings 500 are maintained in a vertically continuous stack with no gaps between individual rings. Maintenance of this constant spring load is necessary because of possible shifts of the blast joint protective sheath during handling and operation and because of the differing rates of thermal expansion which may be exhibited by the structural materials used in blast joint A and the erosion resistant rings 500.

ASSEMBLY

The assembly and use of blast joint A will now be described. This assembly procedure will begin at the lower end of the joint and proceed to the upper end. It should be noted that the joint can also be assembled beginning with the upper end. Beginning at the lower end avoids the necessity of sliding lower housing body 210 onto splines 240 while simultaneously threading lower housing locking collar 230 into the upper end of the lower housing body 210. However, beginning assembly at the lower end requires the application of opposing torque simultaneously at the lower housing body 210 and at the upper housing skirt 410 when the upper housing coupling 420 is threaded onto inner pipe 100. These two torque points can be separated by a distance of twenty feet or more, which can be a problem at some assembly facilities. The order of assembly can be selected by the operator, with top-first assembly being substantially in the reverse order of the following bottom-first assembly.

Beginning with FIG. 1, prior to assembly of lower housing 200 onto blast joint A, lower housing retainer snap ring 250 is slipped over the lower end of inner pipe 100 until it rests in snap ring groove 120. Lower housing splines 240 are then inserted into longitudinal pipe spline grooves 110. The number of splines 240 can vary depending upon pipe diameter; however, a typical number would b eight. Lower housinq body 210 is then slipped over the lower end of inner pipe 100 and slid upwardly until it abuts snap ring 250. During this installation, grooves on the interior of lower housing body 210 align with and slide over splines 240. The lower stack of small diameter, erosion-resistant rings 502 is then slid over the lower end of inner pipe 100, filling the internal annular recess in lower housing body 210. Lower end ring 506 is then slid over the lower end of inner pipe 100 until it abuts the lowermost small diameter ring 502 and it is held in place by threading lower housing end sleeve 220 into the lower end of body 210. A series of large diameter erosion resistant rings 504 are then slipped over the upper end of inner pipe 100 and slid downwardly until they rest in the external annular recess on lower housing body 210 abutting external recess lower shoulder 213. Lower housing locking collar 230 is then slid over the upper end of inner pipe 100 and slid underneath the uppermost large diameter ring 504 previously installed, then threaded into the upper end of lower housing body 210 until locking collar lower end 232 abuts retainer snap ring 250. This determines the longitudinal location of the lower housing relative lo inner pipe 100. Small diameter erosion resistant rings 502 are then slipped over the upper end of inner pipe 100 and stacked vertically with the lower most ring or rings being arranged in the internal annular recess in lower housing locking collar 230. The number and size of erosion resistant rings 500 must be calculated beforehand in order to determine whether a shortened ring 508 will be necessary and whether a lower housing spacer ring 260 will be required to arrive at the desired final overall length of erosion-resistant rings 500.

Referring now to FIG. 2, small diameter rings 502 are continually stacked on inner pipe 100 to a point near the upper end of blast joint A where the intermediate housing 300 will be assembled. Intermediate housing bottom ring 320 is slipped over the upper end of inner pipe 100 and moved downward until the upper end of uppermost small diameter erosion-resistant ring 502 abuts internal recess upper shoulder 328. Large diameter erosion-resistant ring 504 is then slipped over the upper end of inner pipe 100 and moved downward until its lower end abuts external recess lower shoulder 329 of bottom ring 320. Small diameter erosion resistant ring 502 is then slipped over the upper end of inner pipe 100 until its lower end abuts the upper end of bottom ring 320. The lowermost interlocking bridge ring 310 is the slipped over the upper end of inner pipe 100 until it slides over small diameter ring 502 and its lower cylinder 316 slides between large diameter ring 504 and upper cylinder 324 of bottom ring 320. Interlocking bridge ring 310 is then threaded to bottom ring 320. Successive small diameter rings 502, large diameter rings 504 and interlocking bridge rings 310 are then installed over the upper end of inner pipe 100 in the same fashion until the desired length of intermediate housing 300 has been achieved. After installation of the uppermost large diameter ring 504 on intermediate housing 300 has been accomplished, intermediate housing top ring 330 is slipped over the upper end of inner pipe 100 and threaded onto upper cylinder 314 of the uppermost interlocking bridge ring 310. Small diameter rings 502 are then successively installed until the required location of upper housing 400 is reached.

Referring now to FIG. 3, reducer ring 509, if required, is then installed on the top of the stack of small diameter rings 502 followed by installation of load spring 440 on top of reducer ring 509. Coupling 420 is then threaded onto upper threads 130 of inner pipe 100 with upper housing skirt 410 extending downward over load spring 440, reducer ring 509 and small diameter erosion resistant rings 502. Large diameter rings 504 are then installed over the upper end of coupling 420 until the lowermost ring 504 abuts external recess lower shoulder 412. Finally, upper housing top collar 430 is threaded onto the upper end of coupling 420 until erosion-resistant rings 500 are held in place with the uppermost ring 504 abutting external recess upper shoulder 434. When installed as described, skirt 410 provides a surface for the use of power tools to hold blast joint A against angular movement while making up threads 424 with the next uppermost joint. If the next uppermost joint is another blast joint, lower end ring 506 which extends from the lower end of lower housing 200 will extend underneath top collar 430 of the next lower most blast joint providing an overlap between lower end ring 506 and uppermost large diameter ring 504 of the next lowermost blast joint.

As described before, lower housing 200 and upper housing 400 provide surfaces suitable for the use of power tools without excessive damage to the blast joint. Rotational forces on lower housing 200 are transmitted to inner pipe 100 by means of splines 240. No such transfer of torque is necessary from upper housing 400 to inner pipe 100, since, while upper housing 400 is being held against rotation, the remainder of the blast joint simply hangs from threads 422 and 130.

Intermediate housing 300 provides durable raised annular surfaces 312 for the engagement of slip teeth without allowing such teeth to contact erosion-resistant rings 500. Radial forces from the slip teeth are transferred to inner pipe 100 through the structure of interlocking bridge rings 310 which rest directly on the outer surface of inner pipe 100. Intermediate housing 300 can be located longitudinally close to upper housing 400 so that axial loads from the slip teeth will cause intermediate housing 300 to rise until top ring 330 contacts the lower end of upper housing skirt 410. This axial load is then transferred to inner pipe 100 through threads 130 and 422. Load spring 440 is compressed as necessary during the use of pipe slips, but it otherwise maintains intimate contact and the overlapping arrangement between neighboring erosion-resistant rings 500.

The embodiment described here is the preferred embodiment but it can easily be seen how details of construction of some of the components can be modified without changing the function of this invention. To the extent that all such modifications are equivalent, it is intended that they be encompassed within the following claims.

What is claimed:

1. A pipe joint resistant to erosion, comprising:

an inner pipe;

a cylindrical lower housing mounted on the pipe near a lower end of the pipe, suitable for gripping with power tongs without excessive damage to the lower housing;

a plurality of erosion-resistant rings outside the inner pipe arranged concentrically with the lower housing stacked vertically from a first point below the lower housing to a second point above the lower housing without a vertical gap therebetween while allowing access with power tongs to grip the lower housing;

means for locating the lower housing longitudinally on the pipe; and means for securing the lower housing against angular movement relative to the pipe.

2. The pipe joint of claim 1, wherein the cylindrical lower housing comprises:

a cylindrical body;

an end sleeve fastened to a lower end of the body and a locking collar fastened to an upper end of the body.

3. The pipe joint of claim 2, wherein:

the means for locating the lower housing longitudinally comprises a circular snap ring in an annular groove on an external surface of the pipe, protruding from the annular groove into an annular space between the lower housing body and the locking collar; and the means for securing the lower housing against angular movement comprises an elongated spline in a longitudinal groove on an external surface of the pipe, protruding from the longitudinal groove into a longitudinal groove on an internal surface of the lower housing body.

4. The pipe joint of claim 2, wherein the erosion resistant rings concentric with the lower housing are stacked in overlapping groups such that a portion of each group lies radially in line with a portion of each neighboring group.

5. The pipe joint of claim 4, further comprising:

a first annular recess on an internal surface of the cylindrical body;

a second annular recess on an external surface of the cylindrical body;

a third annular recess on an external surface of the locking collar;

a fourth annular recess on an internal surface of the locking collar;

wherein the annular recesses form a vertically continuous recess the full length of the lower housing by overlapping at one of the ends thereof and by abutting at other ends thereof;

wherein the overlapping arrangement of annular recesses is such that the cylindrical body and the locking collar each have surfaces abutting the inner pipe; and wherein a plurality of the erosion-resistant rings are stacked in the annular recesses, extending in a vertically continuous arrangement from a first point below the lower housing to a second point above the lower housing.

6. A pipe joint resistant to erosion, comprising:

an inner pipe;

a cylindrical intermediate housing mounted on the pipe, having a series of raised annular surfaces suitable for gripping with pipe slips without excessive damage to the intermediate housing; and a plurality of erosion-resistant rings outside the inner pipe arranged concentrically with the intermediate housing, from a first point below the intermediate housing to a second point above the intermediate housing without a vertical gap therebetween while allowing access with pipe slips to grip the intermediate housing and means for locating the intermediate housing on the pipe

7. The pipe joint of claim 6, wherein the cylindrical intermediate housing comprises:

a plurality of interlocking bridge rings which fasten to one another at their ends to form and plurality of raised annular external surfaces and with recessed annular external surfaces therebetween and to form a plurality of internal annular surfaces abutting the inner pipe with internal annular recesses therebetween;

a bottom ring fastened to a lowermost bridge ring, having a raised annular external surface near its lower end and a recessed annular internal surface near its lower end; and a top ring fastened to an uppermost bridge ring, having a raised annular external surface near its upper end and a recessed annular internal surface near its upper end.

8. The pipe joint of claim 7, wherein:

the annular recesses form a vertically continuous recess the full length of the intermediate housing by the overlapping of each external recess with each of two neighboring internal recesses; and a plurality of the erosion-resistant rings are arranged in the annular recesses, extending in a vertically continuous arrangement from a first point below the intermediate housing to a second point above the intermediate housing.

9. A pipe joint resistant to erosion, comprising:

an inner pipe;

a cylindrical upper housing mounted on the pipe near an upper end of the pipe, suitable for gripping with power tongs without excessive damage to the upper housing; and a plurality of erosion-resistant rings outside the inner pipe arranged concentrically with the upper housing, stacked vertically from a first point below the upper housing to a second point near the upper end of the upper housing without a vertical gap therebetween while allowing access with power tongs to grip the upper housing; and means for locating the upper housing on the pipe

10. The pipe joint of claim 9, wherein the cylindrical upper housing comprises:

a cylindrical skirt on a lower end of the upper housing, having an external surface suitable for gripping with power tongs, and having an internal annular recess;

a coupling attached to an upper end of the skirt, having an external annular recess and having internal threads suitable for joining the inner pipe to another pipe joint; and a top collar fastened to an upper end of the coupling.

11. The pipe joint of claim 10, wherein the annular recesses form a vertically continuous recess the full length of the upper housing by the overlapping of the lower end of the external recess over the upper end of the internal recess; and a plurality of the erosion-resistant rings are arranged in the annular recesses, extending in a vertically continuous arrangement from a first point below the upper housing to a second point at the top collar.

12. The pipe joint of claim 11, further comprising:

a spring at an upper end of the internal annular recess above the erosion resistant rings, wherein an upper end of the spring bears upwardly against the upper housing, and a lower end of the spring bears downwardly against he uppermost erosion-resistant ring in the internal recess.

13. A pipe joint resistant to erosion, comprising:

an inner pipe;

a cylindrical lower housing mounted on the pipe near a lower end of the pipe, suitable for gripping with power tongs without excessive damage to the lower housing;

means for locating the lower housing longitudinally on the inner pipe;

means for securing the lower housing against angular movement relative to tee inner pipe;

a cylindrical intermediate housing mounted on the pipe, having a series of raised annular surfaces suitable for gripping with pipe slips without excessive damage to the intermediate housing;

a cylindrical upper housing mounted on the pipe near an upper end of the pipe, suitable for gripping with power tongs without excessive damage to the upper housing;

a plurality of internal and external annular recesses on the lower, intermediate and upper housings, with the external recesses overlapping the internal recesses at their ends; and a plurality of erosion-resistant rings arranged in the annular recesses and between the housings concentrically with the pipe in a vertically continuous arrangement from a point near the lower end of the pipe to a point above the upper end of the pipe without a vertical gap between the erosion resistant rings.

* * * * *